United States Patent [19]

Lin

[11] Patent Number: 4,811,816

[45] Date of Patent: Mar. 14, 1989

[54] SYMMETRIC DOUBLE PHONIC DIAPHRAGM VOLUME-ENHANCING DEVICE

[76] Inventor: Tse-Hung Lin, No. 2, Lane 126, Pu Ting Road, Hsinchu City, Taiwan

[21] Appl. No.: 184,817

[22] Filed: Apr. 22, 1988

[51] Int. Cl.[4] ..... G10K 9/12

[52] U.S. Cl. ..... 181/160; 181/144; 181/157; 181/159; 381/82; 381/156; 381/159; 381/186; 381/190; 310/322

[58] Field of Search ..... 181/157, 158, 159, 160, 181/148, 152, 182, 183, 185, 189; 381/156, 159, 173, 190, 191, 82–85, 186; 310/322

[56] References Cited

U.S. PATENT DOCUMENTS 3,025,359 3/1962 Schilling et al. ..... 381/159
3,028,927 4/1962 Levy et al. ..... 381/156
4,190,784 2/1980 Massa ..... 381/190 X
4,330,729 5/1982 Byome ..... 310/322
4,689,609 8/1987 Ko et al. ..... 381/156 X

*Primary Examiner*—B. R. Fuller
*Attorney, Agent, or Firm*—Watson, Cole, Grindle & Watson

[57] ABSTRACT

A device having two sets of oppositely facing corresponding resonance cavities; i.e., an upper and a lower resonance cavity. Each of the resonance cavities include a piezo-electric type diaphragm consisting of a vibration diaphragm and a start-up plate. Electric signals cause the piezo-electric type diaphragm to vibrate back and forth and produce sound waves from the upper and lower resonance cavity.

1 Claim, 2 Drawing Sheets

SYMMETRIC DOUBLE PHONIC DIAPHRAGM VOLUME-ENHANCING DEVICE

BACKGROUND OF THE INVENTION

The present invention relates to a symmetric double phonic-diaphram volume-enhancing device and in particular, to such a device that is provided with two sets of opposite corresponding resonance cavities, one in the upper portion thereof and the other in the lower portion thereof. The upper resonance cavity is formed in such a way that a upper cavity based provided with spiral ribs is joined by a cover body and an arcuate body is joined to the top of the upper resonance cavity. The lower resonance cavity is formed in such a way that a lower cavity base, which is provided with a funnel-type opening, is joined to a cover body, and a base body is also joined to the bottom of the lower resonance cavity. A piezo-electric-type diaphragm which comprises a vibration diaphragm and start-up plate is provided on each of the two resonance cavities respectively. Conductive wires are connected to the vibration diaphragm and the start-up plate respectively. Electrical signals are applied to the conductive wires to cause the piezo-electric type diaphragm to vibrate back and forth due to piezo-electric effects. Sound waves thus generated by the vibrations produce sound waves on the two opposite resonance cavities, so that sound waves released from the sound outlet and out of the spiral channels and opening, therefore, this is a device having two-plate piezo-electric type diaphgrams provided at the same volume to double the sound output thereof.

The present invention relates to a symmetric double phonic diaphragm volume-enhancing device and, in particular, to a piezo-electric-type loud speaker/public address structure which employs the two sets of opposite corresponding resonance cavities, each of the resonance cavities having a piezo-electric-type diaphragm composed of a vibration diaphragm and a start-up plate. The piezo-electric effect makes the electric power diaphragm form back and forth vibrations to reach the doubled volume through opposite vibrations produced by reach the doubled sound through the two plates of piezo-electric-type diagragm to generate sound waves.

Conventional electric power-type electrical sound changing devices are applicable to alarms and loud speakers. Piezo-electric-type loud speakers turn electrical signals into mechanical vibrations and sound vibrations, so the vibration diaphragms extend and retract along their surface. Such extensible and retractible vibrations of the vibration diaphragms form sound waves. The structure of conventional piezo-electric-type loud speakers are mainly single resonance cavity structure with only a single piezo-electric-type diaphragm, so when the piezo-electric-type diaphragm are led out by two conductive wires and also fed with electrical signals, the signal plate piezo-electric-type diaphragm extends and retracts along its extended direction due to the piezo-electric effect to form vibrations in the back and forth direction, thereby transmitting sound waves by vibrations. Conventional piezo-electric-type can generate vibrations to produce unidirectional volume but cannot achieve a more desirable stronger sound output and if and when a higher volume is required, their volume must be increased to achieve the purpose which often causes limits on their efficiency.

The symmetric double phonic diaphragm volume-enhancing device of the present invention seeks to obviate or mitigate the above-mentioned defects.

SUMMARY OF THE INVENTION

Accordingly, the main object of the present invention is to provide two sets of diametrically opposite and corresponding resonance cavities, in each of which a respective piezo-electric diaphragm is provided. Electrical signals are applied to the conductive wires connected to the vibration diaphragms and start-up plates cause piezo-electric-type diaphragms to vibrate due to the piezo-electric effect, and the vibrations cause sound to be emitted from two loud speakers at the same volume achieve the effect of doubled sound output.

In order to understand in detail the structure and features of the present invention, further description is made in conjunction with accompanying drawings as follows:

DETAILED DESCRIPTION OF THE PREFERRED EMBODIMENT

Figure 3:
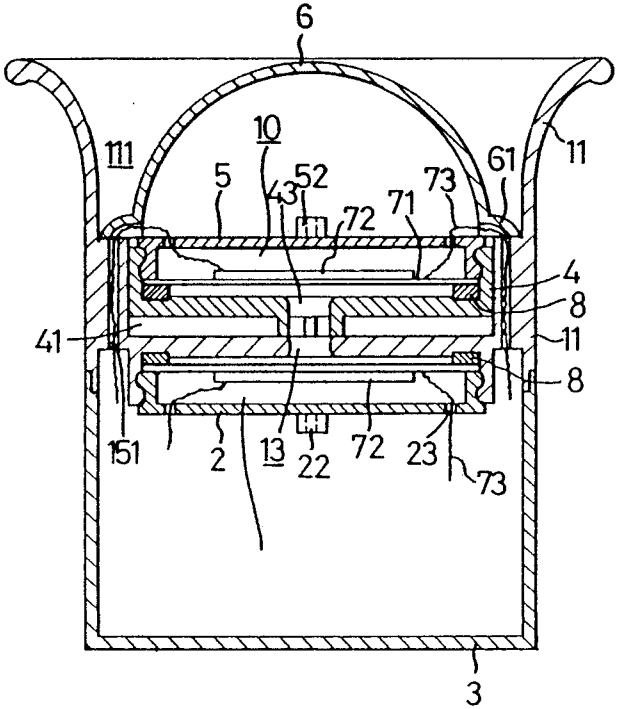
FIG. 3 is a cross-sectional structural view in accordance with the present invention.
Figure 1:
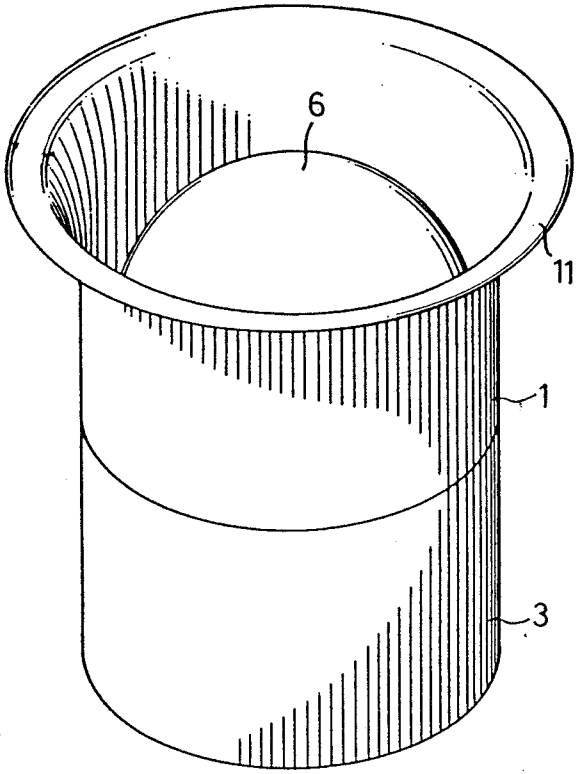
FIG. 1 is a perspective view in accordance with the present invention.
Figure 2:
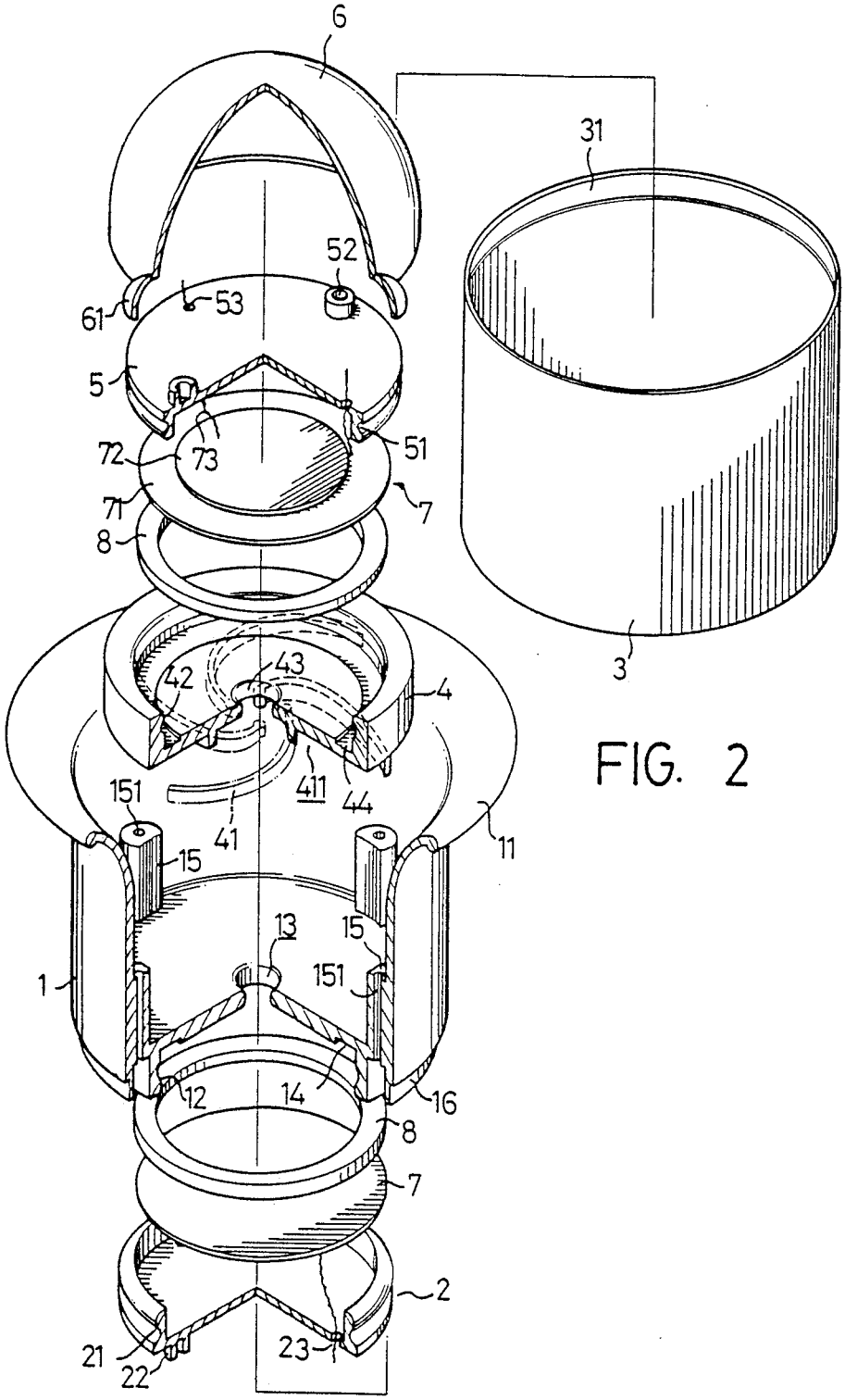
FIG. 2 is an exploded view in accordance with the present invention.

Please see FIG. 1, 2 and 3. In the present invention, the lower cavity base 1 is joined with a cover body 2 to form the lower resonance cavity 9, the lower part of which is joined with a base body 3. The upper cavity base 4 is joined with a cover body 5 to form the upper resonance cavity 10, and the top thereof engages with an arcuate body 6.

The lower cavity base 1 is a basin-shaped body having a bottom cover with a funnel-type opening 11 extending upwardly therefrom and with a tenon 16 extended from a protruding ring 12. An annular groove 14 is provided in the bottom of the bottom cover in the inner perimeter of the protruding ring 12. Four equally spaced convex platforms 15 are provided on the bottom cover in the inner perimeter of the funnel-type opening 11, and a hole 151 is provided in each of the four convex platforms. A sound outlet 13 is provided at the center of the bottom cover of the lower cavity base 1. The cover body 2 is a round plate body with a concave ring 21 extending upwardly on the perimeter and a hole 23 and convex rib 22 at proper positions thereon. The protruding ring 21 of the cover body 2 engages on the protruding ring 12 of the lower cavity base 1 with the concave and convex opposite corresponding structures tightly engaging the cover body 2 with the lower cavity base 1, thereby making the inner parts thereof form a lower resonance cavity 9. The connection tenon 31 on the top of a bucket-shaped base body 3 is engaged with the tenon 16 of the lower cavity base 1 to secure the base body 3 on the lower cavity base 1. An annular pad 8 may be at first placed in the annular groove 14 in the lower cavity base 1, and also a piezo-electric diaphragm 7 is set thereon and is composed on a vibration diaphragm 71 and a start-up plate 72 and is also fixed by the clamping of the pad support of annular pad 8 and the cover body 2 to the piezo-electric diaphragm 7 at a proper distance away from the lower cavity base 1. Further, a start-up plate 72 is installed on the vibration diaphragm 71 and also has two conductive wires 73 passing through hole 23 and being connected to the circuit board which is fixed on the cover body 2 by the convex rib 22 in the space between the cover body 2 and base body 3.

The lower side of the upper cavity base 4 is provided with a base body having four spiral ribs 41, and a sound outlet 43 is formed in the center of the base body. A protruding ring 42 protrudes upwardly on and from the perimeter of the base body, an annular groove 44 is provided at a proper position inside the perimeter of the base body, and channel 411 is formed between the spiral ribs 41.

Cover body 5 and cover body 2 have the identical structure to use the concave ring 51 to engage on the protruding ring 42, thereby making the cover body 5 tightly engaged on the upper cavity base 4, so the inner parts of both of them form an upper resonance cavity 10. The upper side of the cover body 5 is joined with an arcuate body 6 which is an arcuate-surfaced shell body and is equally spaced with four arcuate protruding pieces 61.

An annular pad 8 is placed in the annular groove 44 in the upper cavity base 4 which is also set with a piezo-electric diaphragm 7 that is fixed by the clamping of the annular pad 8 and cover body 5, thereby keeping the piezo-electric diaphragm 7 a proper distance away from the upper cavity base 4. Further, two conductive wires 73 each come from the vibration diaphragm 71 and the start-up plate 72 respectively and go through holes 53 and then the space of the protruding pieces 61 and the hole 151 and are connected to the circuit board in the lower side, and the installation of convex ribs 52 can also make the circuit board placed in the space between the upper side of the cover body 5 and the arcuate body 6.

The member is formed by the cover body 2 and base body 3 which are engaged with the lower cavity base 1, and another member is formed by the cover body 5 and arcuate body 6 which are engaged with the upper cavity base 4. The two members are welded on the bottom cover of the lower cavity base 1 with spiral ribs 41 by means of high frequency waves. The spaces of the afore-said holes 23, 53, 151 and arcuate convex pieces 61 are also filled up with sealant after the spiral ribs 41 are welded thereon to insure the air-tightness of the upper and lower resonance cavities 9, 10.

When the conductive wires 73 are connected the circuit board and input with electrical signals, the two plate piezo-electric-type diaphragm 7 will be urged to vibrate due to the piezo-electric effect, and sound waves are generated due to the vibrations. The sound waves generated by the two opposite corresponding resonance cavities 9, 10 are released from respective sound outlets 13, 43 and then go through the spiral channels 411 and are transmitted to the opening 111 between the lower cavity base 1 and arcuate body 6, and a two-plate piezo-electric type diaphragm 7 device is provided in the piezo-electric loud speaker at the same volume to double the sound output thereof.

Summing up all of the above, the two symmetric sound cavities provided in the present invention generate sound by the piezo-electric-type diaphragm in the resonance cavities radiated and ejected out from a spiral channel to have the effect of doubling the sound output for the piezo-electric-type loud speakers of the same volume for application in alarms or loud speakers.

I claim:

1. A symmetric two-diaphragm sound-enhancing device comprising:

a lower cavity base in a basin-shaped body having a bottom cover from which a funnel-type opening extends upwardly and also having a tenon provided downward on a perimeter thereof, a protruding ring formed on an inner perimeter, four equally-spaced convex platforms provided on the bottom cover in the inner perimeter of the funnel-type opening, a hole provided in each of the four convex platforms, a sound outlet provided at a center of the bottom cover and a concave annular groove provided at a proper place on said bottom cover;

an upper cavity base provided with four spiral ribs on a lower side thereof, having a sound outlet formed at a center of the cavity base, a protruding ring on a perimeter thereof extending downward and an annular groove provided at a proper place on an inside perimeter thereof;

two cover bodies each of which is in a round plate body and has a concave ring on a perimeter thereof extending upwardly, and a hole and convex ribs provided at proper places thereon;

a base body having an annular body extending upwardly, a connection tenon provided on an end of said annular body;

an arcuate body in an arcuate surfaced shell body having four equally spaced convex pieces provided on a perimeter thereof;

said concave rings of the two cover bodies being engaged with respective convex rings on the upper and lower cavity bases to form upper and lower resonance sound cavities respectively, an annular pad and a piezo-electric-type diaphragm are provided in each of the sound cavities respectively; the tenon of the lower cavity base being joined to the connection tenon on the base body of the lower cavity base, the upper cavity base being joined with the arcuate body to make the arcuate body and a top of the lower cavity base form an opening piezo-electric-type diaphragm so that conductive wires go through holes provided therefor and spaces of the arcuate convex pieces and said spiral ribs are joined to the bottom cover of the lower cavity base.

* * * * *